US006918156B2

(12) United States Patent
Joo et al.

(10) Patent No.: US 6,918,156 B2
(45) Date of Patent: Jul. 19, 2005

(54) SUCTION BRUSH ASSEMBLY HAVING ROTATION ROLLER FOR SWEEPING DUST

(75) Inventors: Sung-tae Joo, Gwangju (KR); Jang-keun Oh, Gwangju (KR)

(73) Assignee: Samsung Gwangju Electronics, Co., Gwanju (KR)

( * ) Notice: Subject to any disclaimer, the term of this patent is extended or adjusted under 35 U.S.C. 154(b) by 358 days.

(21) Appl. No.: 10/195,545

(22) Filed: Jul. 16, 2002

(65) Prior Publication Data

US 2003/0163888 A1 Sep. 4, 2003

(30) Foreign Application Priority Data

Mar. 4, 2002 (KR) ..... 2002-11240

(51) Int. Cl.[7] ..... A47L 5/10
(52) U.S. Cl. ..... 15/388; 15/48.1; 15/384
(58) Field of Search ..... 15/27, 41.1, 48.1, 15/52.1, 98, 383, 384, 388, 389, 377

(56) References Cited

U.S. PATENT DOCUMENTS

| | | | | |
|---|---|---|---|---|
| 755,596 A | * | 3/1904 | Keyes | 15/347 |
| 901,978 A | | 10/1908 | Mally et al. | |
| 1,077,518 A | | 11/1913 | Pulper | |
| 1,106,329 A | | 8/1914 | Pulper | |
| 1,119,393 A | * | 12/1914 | Binkley | 15/356 |
| 1,613,396 A | * | 1/1927 | Keller, Sr. | 15/368 |
| 2,536,443 A | | 1/1951 | Hammell | |
| 3,733,646 A | | 5/1973 | Mein | 15/369 |
| 4,366,593 A | | 1/1983 | Parikh | |
| 4,903,369 A | | 2/1990 | Kitamura et al. | |
| 5,960,514 A | | 10/1999 | Miller et al. | |

FOREIGN PATENT DOCUMENTS

| | | |
|---|---|---|
| CN | 2104624 U | 5/1992 |
| CN | 2115757 U | 9/1992 |
| CN | 236482 Y | 2/2000 |
| DE | 2 227 612 | 6/1972 |
| DE | 7407795 | 9/1974 |
| DE | 29 21 874 | 12/1979 |
| FR | 2096807 | 3/1972 |
| GB | 464358 | 4/1937 |
| GB | 875148 | 8/1961 |
| GB | 2 021 937 | 12/1979 |
| JP | 5228084 | 9/1993 |
| JP | 11009521 | 1/1999 |
| JP | 2000102499 | 4/2000 |
| JP | 2002028112 | 1/2002 |

OTHER PUBLICATIONS

Russian Official Action issued Jan. 19, 2004 from the Russian Patent Office with respect to Russian Patent Application No. 2002121918 filed on Aug. 9, 2002.
German Examination Report issued Mar. 4, 2004 from the German Patent Office with respect to German Patent Application No. 10240625.
British Patent Office Search Report (4 pp.).
Canadian Patent Office, Canadian Patent Office Action issued Jul. 6, 2004 with respect to Canadian Patent Application No. 2,399,827 filed on Aug. 27, 2002.
Chinese Office Action issued Dec. 3, 2004 with respect to Chinese Patent Application No. 02142458.6, filed on Sep. 19, 2002.

* cited by examiner

*Primary Examiner*—Terrence R. Till
(74) *Attorney, Agent, or Firm*—Blank Rome LLP

(57) ABSTRACT

A suction brush assembly of a vacuum cleaner has a housing having a suction duct to provide a suction passage for dust, a rotation roller having a plurality of ribs formed at an outer circumference, a wheel disposed at the housing, and a power transmission unit to rotate the rotation member by exerting a rotation force of the wheel to the rotation member when the wheel is rotated. The wheel and the rotation member are rotated in directions opposite to each other by the power transmission unit. When a user wants to clean fabrics such as bedclothes or a carpet, the effect of hitting of the ribs can be firmly secured due to the rotation of the rotation rollers. Therefore, the effect of removing dust remarkably increases.

24 Claims, 4 Drawing Sheets

(PRIOR ART)

SUCTION BRUSH ASSEMBLY HAVING ROTATION ROLLER FOR SWEEPING DUST

BACKGROUND OF THE INVENTION

1. Field of the Invention

The present invention relates to a vacuum cleaner, and more particularly, to a suction brush assembly having a rotation roller for sweeping dust from bedclothes and etc., and a vacuum cleaner having the same.

2. Description of the Prior Art

FIG. 1 is a view showing the appearance of a conventional vacuum cleaner. The conventional vacuum cleaner has a body 10 having a driving device such as a motor, a connection hose 32 connected with the body 10, a handle 33 disposed at the end of the connection hose 32, an extension pipe 31 disposed at the handle 33, and a brush 20 disposed at the end of the extension pipe 31. When a user drives the vacuum cleaner by manipulating a switch 33*a* disposed at the handle 33, the vacuum cleaner conducts a suction operation as the motor in the body 10 is driven. Accordingly, dust is drawn into the vacuum cleaner through a suction port formed at the bottom of the brush 20. The drawn dust is collected in a dust-collecting chamber (not shown) in the body 10 through the connection hose 32 connected with the extension pipe 31.

Generally, the above brush 20 is used when the user cleans the floor, but sometimes there is a difficulty in applying the brush 20 depending on the condition of the surface. Therefore, the brush 20 is manufactured to be able to separate from the extension pipe 31, allowing the user to install another type of brush.

The brush can be one for cleaning fabrics, such as bedclothes, and carpets. The brush for cleaning fabrics may have a rotation roller rotated by friction force with the fabrics when the brush moves on the fabrics. A plurality of protrusions are formed on the outer circumference of the rotation roller. Therefore, when the rotation roller is rotated, the protrusions hit the fabrics. This results in the dust on the fabrics getting off from the fabrics, and the fallen dust being drawn through the brush. Thus, the effect for removing dust increases.

However, since the rotation roller is simply rotated by the friction force with the fabrics in the conventional brush for fabrics, there is a problem in that the rotation roller cannot be easily rotated. In that case, the cleaning efficiency can be weak or even non-existent.

Moreover, the rotation of the rotation roller is substantially generated as the protrusions formed on the rotation roller are caught by the fabrics. In other words, the rotation roller is rotated as one of the protrusions is caught at the fabrics while the brush is moving on the fabrics, and thus, other protrusions hit the fabrics. Accordingly, all of the protrusions hit the fabrics, resulting in a weakened hitting efficiency.

SUMMARY OF THE INVENTION

The present invention has been made to overcome the above-mentioned problems of the prior art. Accordingly, it is an object of the present invention to provide a suction assembly of a vacuum cleaner enabling a user to clean fabrics more efficiently as the effect of removing dust on the fabrics increases.

A suction brush assembly of a vacuum cleaner according to the present invention to accomplish the above object comprises: a housing having a suction duct to provide a suction passage for dust; a rotation member rotatably disposed close to a suction port of the suction duct and having at least one protrusion formed on an outer circumference thereof; at least one wheel disposed at the housing; and a power transmission unit to rotate the rotation member by transmitting a rotation force of the wheel to the rotation member when the wheel is rotating.

It is preferable that the wheel and the rotation member are rotated in directions opposite to each other by the power transmission unit. The power transmission unit includes: a driving gear rotated together with the wheel; and a driven gear rotated by the driving gear together with the rotation member.

A pair of rotation members are disposed respectively at both sides of the suction port, and the pair of rotation members are relatively fixed by the settlement member.

It is preferable that the rotation member has a shape of a roller parallel to a rotation axis of the wheel, and the protrusion has a shape of a rib disposed along the longitudinal direction of the rotation member.

A friction member such as a rubber strip is disposed at the outer circumference of the wheel so that the rotation of the wheel can be secured.

The rotation member can move within a predetermined range so that the height thereof can be changed.

According to the present invention, when the user wants to clean fabrics such as bedclothes or a carpet, the effect of hitting is firmly secured, thus the effect of removing dust remarkably increases.

Also, according to the present invention, a vacuum cleaner having the above suction brush assembly is provided.

BRIEF DESCRIPTION OF THE DRAWINGS

The above-mentioned object and the feature of the present invention will be more apparent by describing the preferred embodiment of the present invention by referring to the appended drawings, in which.

DESCRIPTION OF THE PREFERRED EMBODIMENT

Figure 1:
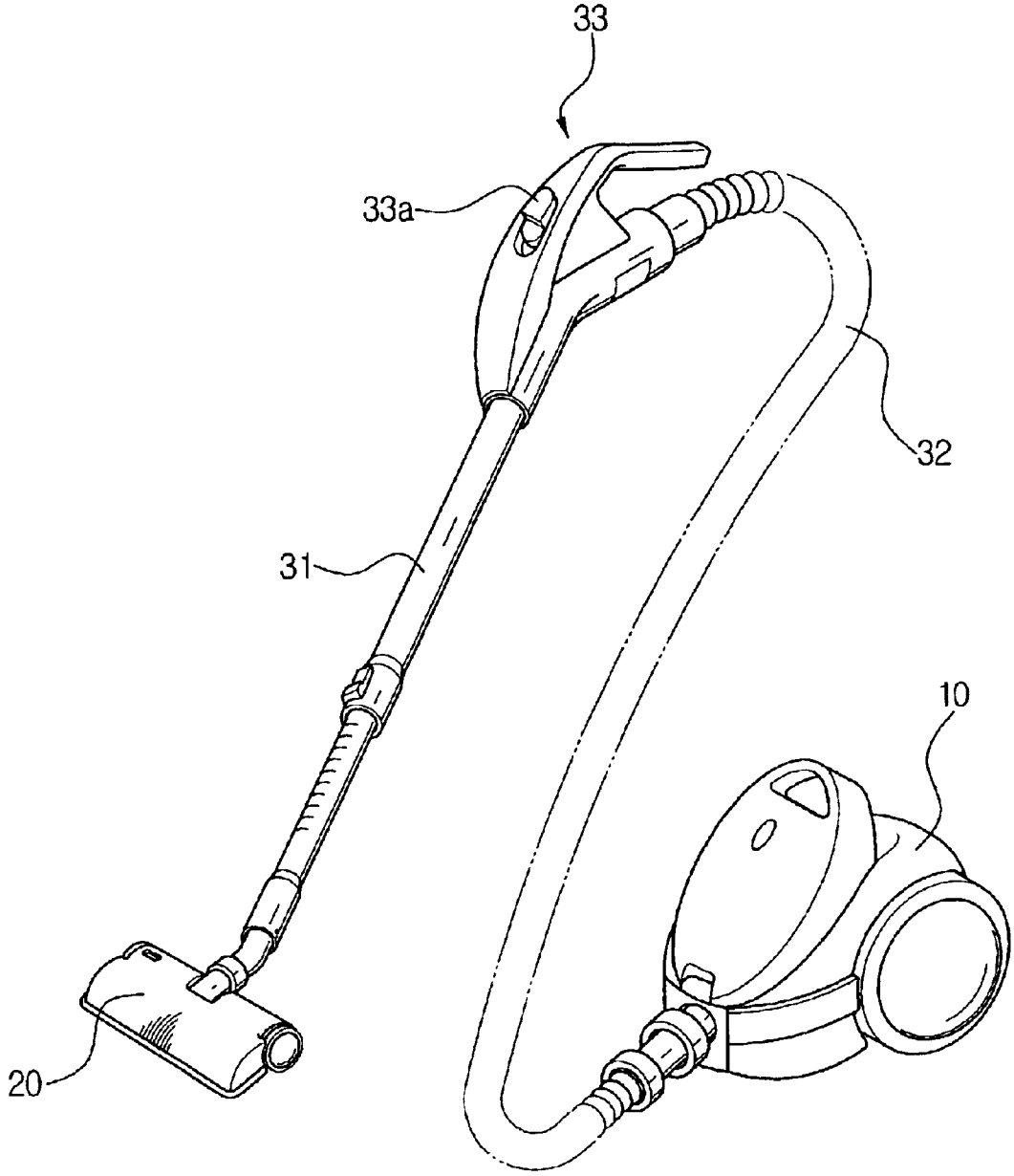
FIG. 1 is a perspective view showing a conventional vacuum cleaner.

Hereinbelow, the preferred embodiment of the present invention will be described in greater detail by referring to the appended drawings. In the drawings, the same reference numbers represent the same or similar elements in the different drawings whenever possible. In the description of the present invention, the description of each part of a conventional vacuum cleaner as shown in FIG. 1 will be omitted.

Figure 2:
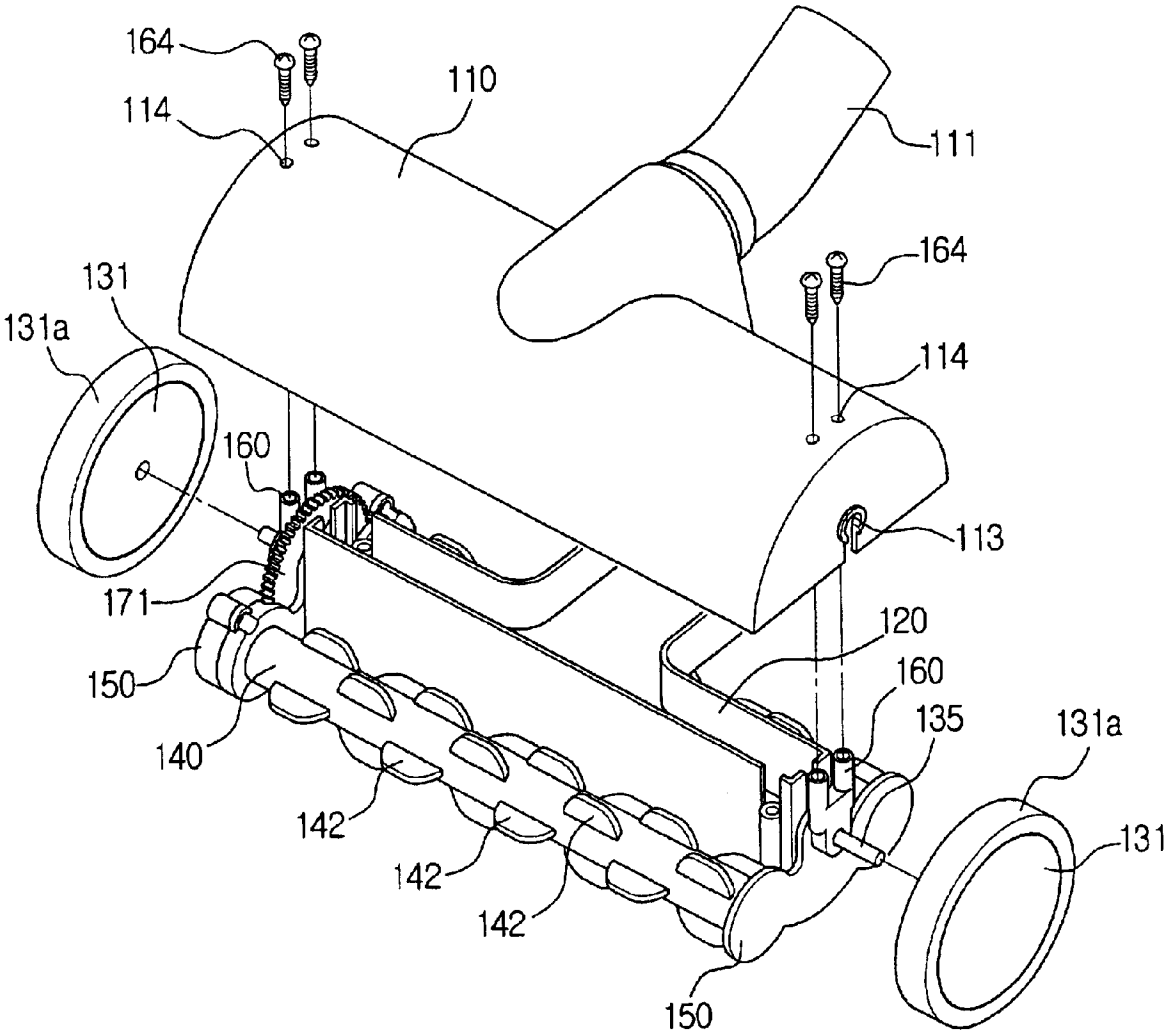
FIGS. 2 and 3 are exploded perspective views showing a suction brush assembly according to the present invention.
Figure 3:
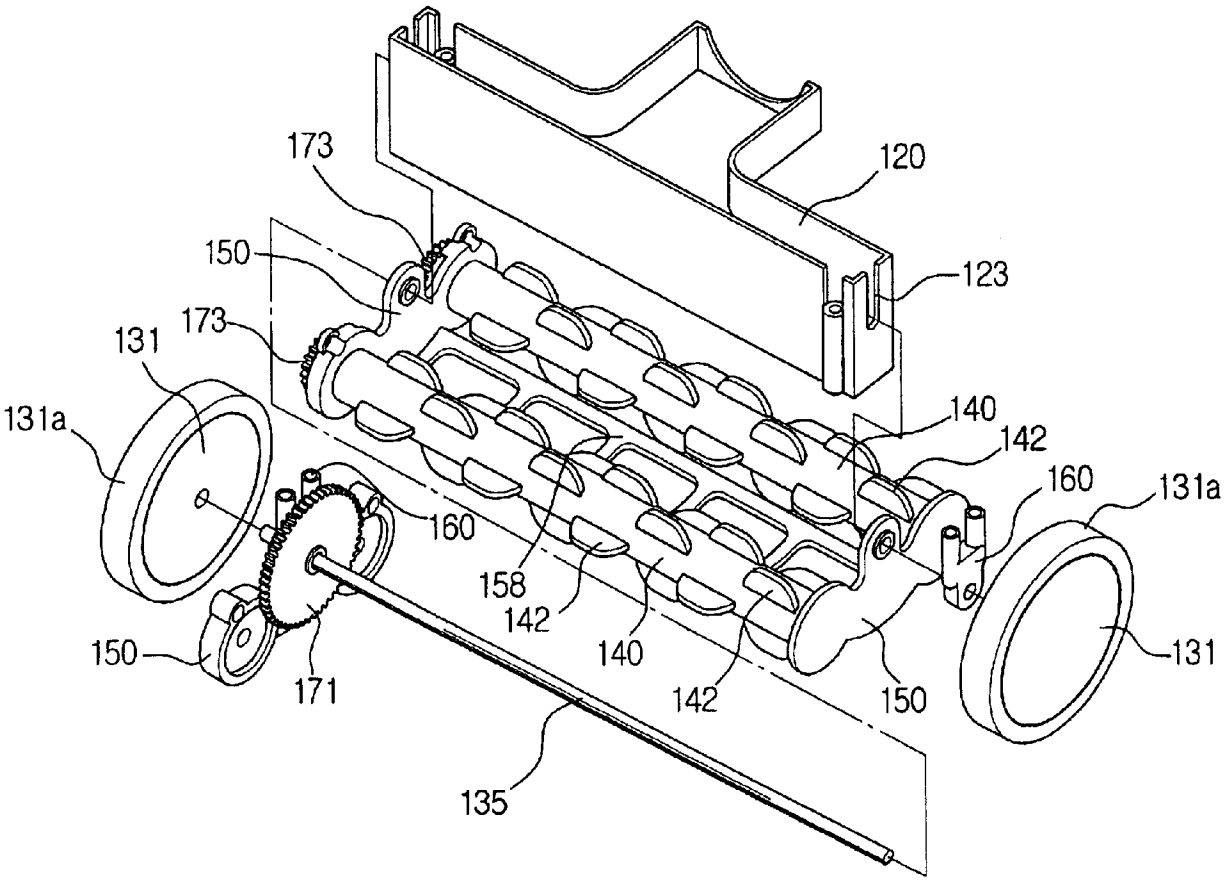

FIGS. 2 and 3 are exploded perspective views showing a suction brush assembly according to the present invention. The suction brush assembly has a housing 110 connected with an extension pipe (not shown) of the vacuum cleaner, a pair of rotation rollers 140 disposed at a lower part of the housing 110, and a pair of wheels 131 disposed at both sides of the housing 110.

The housing 110 has a connection pipe 111 connected with the extension pipe of the vacuum cleaner. A duct member 120 is installed at the lower part of the housing 110. The duct member 120 and the housing 110 form a suction duct to provide a suction passage for drawing dust when the vacuum cleaner operates.

The rotation rollers 140 are rotatably installed at both sides of a suction port at the position close to the suction port of the suction duct. At this time, it is preferable that the rotation rollers 140 are disposed to allow its rotation axis to be parallel to a rotation shaft 135 described later. Moreover, the installation positions of a pair of rotation rollers 140 are forward and backward of advancing direction of the suction brush when the suction brush is used for cleaning. In the preferred embodiment of the present invention, the rotation rollers 140 have been exemplified, but it is not limited to the shape of roller and another type of rotation member rotatably disposed at the housing 110 can be applied.

A plurality of ribs 142 are formed at the outer circumference of the rotation rollers 140. The ribs 142 are disposed by a predetermined distance in a longitudinal direction of the rotation rollers 140. In addition, the ribs 142 are disposed at different positions on a rotational direction of the rotation rollers 140. Accordingly, the ribs 142 form a plurality of rows. In the preferred embodiment of the present invention, the example that the ribs 142 are formed has been described, but another type of protrusions other than the ribs 142 can be formed.

The pair of rotation rollers 140 are relatively settled by settlement members 150. The settlement members 150 are connected to both ends of the rotation rollers 140. In this situation, the settlement members 150 are connected to the rotation rollers 140 to allow the rotation rollers 140 to be rotated.

The rotation shaft 135 is penetrating the settlement members 150. Thus, the rotation shaft 135 is rotatably supported by the settlement members 150.

Connection members 160 are connected with the both ends of the rotation shaft 135. Thus, the settlement member 140 is rotatably connected with the connection members 160. Several screws 164 penetrating connection holes 114 formed at the housing 110 are connected with the connection members 160. Accordingly, the connection members 160 are firmly fixed at the housing 110, and the settlement member 150 and the rotation rollers 140 connected with the settlement member 150 can be rotated within a predetermined range with respect to the housing 110.

FIG. 3 shows a suction grill 158 disposed close to the suction port of the suction duct and formed at the bottom of the settlement member 140. The suction grill 158 can be formed integrally with the settlement member 140 or can be formed separately with the settlement member 140.

Recesses 113 are formed at both sides of the housing 110 (see FIG. 2). The rotation shaft 135 is embraced in the recesses 113 when the housing 110 is connected to the duct member 120. Accordingly, the rotation shaft 135 takes a shape of substantially penetrating the housing 110.

Two wheels 131 are installed at both ends of the rotation shaft 130. The wheels 131 are contacted with the floor when the suction brush assembly is placed on the floor. Thus, a user can clean the floor by moving the suction brush assembly. Friction members 131*a* for easier rotation by increasing the friction force with the floor are installed at the outer side of the wheels 131. A preferable example of the friction members 131*a* is a rubber strip encircling the entire outer circumference of the wheels 131.

The rotation force of the wheels 131 is transferred to the rotation rollers 140 by a power transmission unit. The power transmission unit includes a driving gear 171 rotated by the rotation shaft 135 and a driven gear 173 disposed at the rotation rollers 140. The driving gear 171 is installed at one part of the rotation shaft 135 and rotated together with the rotation shaft 135. The driven gear 173 is engaged with the driving gear 171 and rotated together with the rotation rollers 140. The driven gear 140 can be integrally formed with the rotation rollers 140. The wheels 131 and the rotation rollers 140 are rotated in directions opposite to each other by the power transmission unit.

Hereinbelow, the operation of the suction brush assembly of the vacuum cleaner according to the present invention having the above structure will be described referring to FIGS. 4 and 5.

Figure 4:
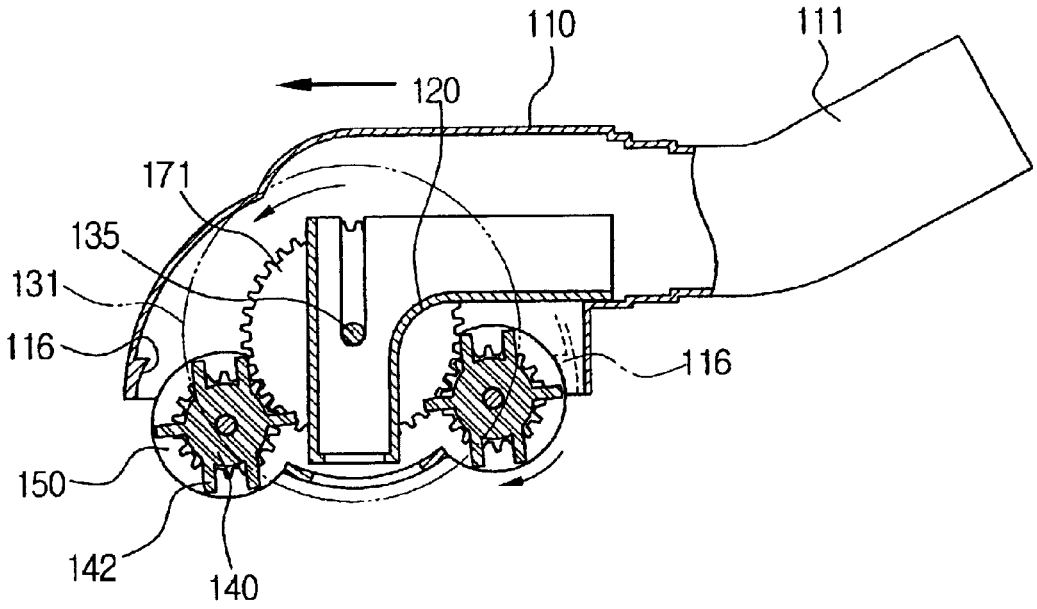
FIGS. 4 and 5 are partial views showing the status of usage of the suction brush assembly according to the present invention.

When the user moves the suction brush assembly forwardly, the wheels 131 are rotated in a counterclockwise direction and the rotation rollers 140 are rotated in a clockwise direction by the rotation of the driving gear 171 and the driven gear 173 as shown in FIG. 4. Accordingly, the bedclothes or the carpet under the suction brush assembly is hit by the ribs 142 formed at the rotation rollers 140. Therefore, dust on the bedclothes or the carpet falls and the fallen dust is drawn through the suction duct formed by the housing 110 and the duct member 120. At this time, the suction grill 158 prevents the bedclothes from being drawn into the suction duct.

Figure 5:
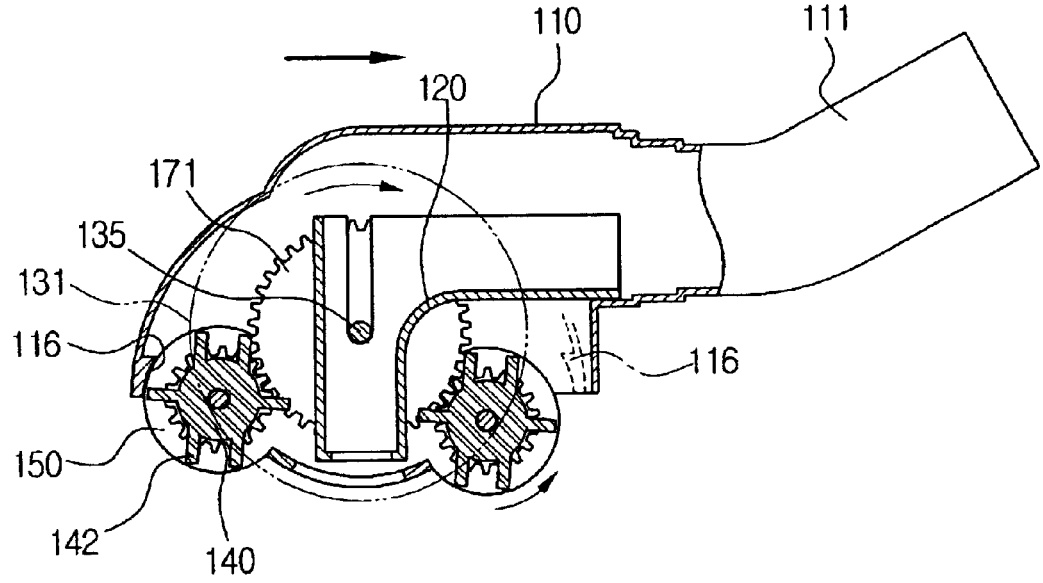

When the user moves the suction brush assembly backwardly, the wheels 131 are rotated in the clockwise direction and the rotation rollers 140 are rotated in the counterclockwise direction by the rotation of the driving gear 171 and the driven gear 173 as shown in FIG. 5.

When the rotation rollers 140 are rotated by the movement of the suction brush assembly, the rotation rollers 140 are rotated not by the friction force with the bedclothes on the floor but by the rotation force of the wheels 131. Moreover, the rotation of the wheels 131 is secured by the friction members 131*a* installed at the wheels 131. Therefore, the rotation rollers 140 are always rotated, thus the effect of hitting the bedclothes is maintained all the time.

In addition, as the rotation rollers 140 are rotated in direction opposite to the advancing direction of the suction brush assembly due to the structure of the power transmission unit, all of the ribs 142 of the rotation rollers 140 hit the bedclothes. Additionally, the ribs 142 hit the bedclothes at a speed which is the addition of the advancing speed of the suction brush assembly and the rotation speed of the rotation rollers 140, and thus, the effect of the hitting is remarkably increased.

On the other hand, as the entire duct member 120 is rotatable within a predetermined range with respect to the housing 110 as described before, the settlement member 150 fixed for the duct member 120 and the rotation rollers 140 are sloped by the friction force in accordance with the movement of the suction brush assembly. In other words, when the suction brush assembly advances forwardly, the rotation roller 140 placed in the front moves downwardly and the rotation roller 140 placed in the rear moves upwardly as show in FIG. 4. Moreover, when the suction brush assembly moves backwardly, the rotation roller 140 placed in the front moves upwardly, and the rotation roller 140 placed in the rear moves downwardly as shown in FIG. 5.

In the present invention, the rotation rollers 140 are rotated by the wheels 131, thus the height of the bottom of the rotation rollers 140 should be higher than that of the wheels 131. In that case, the effect of hitting can be reduced due to the distance between the rotation rollers 140 and the bedclothes. Therefore, the rotation rollers 140 should be sloped with respect to the advancing direction so that the rotation rollers 140 are firmly contacted with the bedclothes and the effect of the hitting can be secured. Especially, as shown in FIGS. 4 and 5, the rotation rollers 140 are placed in the front so that they hit the bedclothes, thus, the bedclothes are firstly hit and the dust is drawn later.

Hooking protrusions 116 are formed in the front inner side and the rear inner side of the housing 110. As shown in FIGS. 4 and 5, the hooking protrusions 116 are caught at one part of the settlement member 150 when the rotation rollers 140 are rotated. Therefore, the angle of the rotation rollers 140 being sloped may be limited within a predetermined range due to the hooking protrusions 116. Accordingly, as the movement range of the rotation rollers 140 is limited, the user can use the vacuum cleaner more conveniently.

As described so far, according to the present invention, as the rotation rollers 140 are rotated by the wheels 131 in the direction opposite to that of the wheels 131, the effect of the hitting of the rotation rollers 140 increases. Therefore, when the user wants to clean the bedclothes or the carpet, the effect of removing dust increases as well.

Although the preferred embodiment of the present invention has been described, it will be understood by those skilled in the art that the present invention should not be limited to the described preferred embodiment, but various changes and modifications can be made within the spirit and the scope of the present invention. Accordingly, the scope of the present invention is not limited to the described embodiments.

What is claimed is:

1. A suction brush assembly of a vacuum cleaner comprising:

a housing having a suction duct to provide a suction passage for dust;

a pair of rotation members rotatably disposed close to both sides of a suction port, respectively, of the suction duct and having at least one protrusion formed on an outer circumference thereof;

at least one wheel disposed at the housing;

a power transmission unit to rotate the rotation members by exerting a rotation force of the wheel to the rotation members when the wheel is rotating; and a settlement member to relatively fix the pair of rotation members.

2. The suction brush assembly of the vacuum cleaner of claim 1, wherein the wheel and the rotation member are rotated in directions opposite to each other by the power transmission unit.

3. The suction brush assembly of the vacuum clean of claim 1, wherein the transmission unit includes:

a driving gear rotated together with the wheel; and a driven gear rotated by the driving gear together with the rotation member.

4. The suction brush assembly of the vacuum cleaner of claim 3, further comprising a rotation shaft disposed at the housing and having the wheel, wherein the driving gear is disposed at a part of the rotation shaft.

5. The suction brush assembly of the vacuum cleaner of claim 1, wherein the settlement member has a suction grill disposed close to the suction port.

6. The suction brush assembly of the vacuum cleaner of claim 1, wherein the rotation member has a shape of a roller parallel to a rotation axis of the wheel.

7. The suction brush assembly of the vacuum cleaner of claim 6, wherein the protrusion has a shape of a rib disposed along a longitudinal direction of the rotation member.

8.The suction brush assembly of the vacuum cleaner of claim 7, wherein a plurality of ribs are disposed at a different place in a rotating direction of the rotation member.

9. The suction brush assembly of the vacuum cleaner of claim 1, further comprising a friction member disposed at an outer circumference of the wheel.

10. The suction brush assembly of the vacuum cleaner of claim 9, wherein the friction member is a rubber strip encircling the outer circumference of the wheel.

11. The suction brush assembly of the vacuum cleaner of claim 1, wherein the rotation member can move within a predetermined range so that the height thereof can be changed.

12. The suction brush assembly of the vacuum cleaner of claim 11, further comprising a means for limiting the movement of range of the rotation member.

13. The suction brush assembly of the vacuum cleaner of claim 12, wherein the means for limiting is a hooking protrusion formed on an inner side of the housing.

14. A vacuum cleaner comprising a suction brush having a construction described in claim 1.

15. A suction brush assembly of a vacuum cleaner, comprising:

a housing having a suction duct to provide a suction passage for dust;

a rotation member rotatably disposed close to a suction port of the suction duct and having at least one protrusion formed on an outer circumference thereof, the rotation member having a shape of a roller parallel to a rotation axis of the wheel and the protrusion having a shape of a rib disposed along a longitudinal direction of the rotation member;

at least one wheel disposed at the housing; and a power transmission unit to rotate the rotation member by exerting a rotation force of the wheel to the rotation member when the wheel is rotating.

16. The suction brush assembly of claim 15, wherein a plurality of ribs are disposed at a different place in a rotating direction of the rotation member.

17. The suction brush assembly of claim 15, further comprising a friction member disposed at an outer circumference of the wheel.

18. The suction brush assembly of claim 15, wherein the friction member is a rubber strip encircling the outer circumference of the wheel.

19. The suction brush assembly of claim 15, wherein the rotation member can move within a predetermined range so that the height thereof can be changed.

20. The suction brush assembly of claim 15, further comprising a means for limiting the movement of range of the rotation member.

21. The suction brush assembly of claim 20, wherein the means for limiting is a hooking protrusion formed on an inner side of the housing.

22. A suction brush assembly of a vacuum cleaner, comprising:

a housing having a suction duct to provide a suction passage for dust;

a rotation member rotatably disposed close to a suction port of the suction duct and having at least one protrusion formed on an outer circumference thereof;

at least one wheel disposed at the housing;

a power transmission unit to rotate the rotation member by exerting a rotation force of the wheel to the rotation member when the wheel is rotating; and the rotation member can move within a predetermined range so that the height thereof can be changed.

23. The suction brush assembly of claim 22, further comprising a means for limiting the movement of range of the rotation member.

24. The suction brush assembly of claim 22, wherein the means for limiting is a hooking protrusion formed on an inner side of the housing.

* * * * *